US010926374B2

(12) United States Patent
Shinozaki et al.

(10) Patent No.: US 10,926,374 B2
(45) Date of Patent: Feb. 23, 2021

(54) SUBSTRATE PROCESSING APPARATUS

(71) Applicant: Ebara Corporation, Tokyo (JP)

(72) Inventors: Hiroyuki Shinozaki, Tokyo (JP); Shuichi Kamata, Tokyo (JP); Koichi Takeda, Tokyo (JP); Ryuichi Kosuge, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 517 days.

(21) Appl. No.: 15/475,335

(22) Filed: Mar. 31, 2017

(65) Prior Publication Data

US 2017/0291274 A1 Oct. 12, 2017

(30) Foreign Application Priority Data

Apr. 6, 2016 (JP) ..... JP2016-076569

(51) Int. Cl.
*B24B 37/005* (2012.01)
*B24B 37/30* (2012.01)
*B24B 37/20* (2012.01)

(52) U.S. Cl.
CPC ..... *B24B 37/005* (2013.01); *B24B 37/20* (2013.01); *B24B 37/30* (2013.01)

(58) Field of Classification Search
None
See application file for complete search history.

(56) References Cited

U.S. PATENT DOCUMENTS 7,044,832 B2 5/2006 Yilmaz et al.
7,559,823 B2 * 7/2009 Sato ..... B24B 37/345 451/11
8,070,560 B2 * 12/2011 Yasuda ..... B24B 37/30 451/286
8,083,571 B2 * 12/2011 Nabeya ..... B24B 37/30 451/9
8,388,409 B2 * 3/2013 Nakao ..... B24B 37/013 156/345.12
9,105,516 B2 8/2015 Nakamura
9,370,852 B2 * 6/2016 Takahashi ..... B24B 37/005
9,673,067 B2 * 6/2017 Yokoyama ..... H01L 21/67046
9,709,661 B2 * 7/2017 Crombez ..... G01S 5/0263
10,029,344 B2 * 7/2018 Kamata ..... B24B 37/30
10,391,603 B2 * 8/2019 Yamaki ..... B24B 37/20
2014/0004779 A1 * 1/2014 Namiki ..... B24B 37/32 451/365
2014/0357164 A1 * 12/2014 Nabeya ..... B24B 37/30 451/288
2015/0224620 A1 * 8/2015 Takahashi ..... B24B 37/005 451/442

(Continued)

FOREIGN PATENT DOCUMENTS

JP 2011-258639 A 12/2011
JP 2015-082586 A 4/2015

*Primary Examiner* — Sylvia MacArthur
(74) *Attorney, Agent, or Firm* — Abelman, Frayne & Schwab

(57) ABSTRACT

The present disclosure provides a substrate processing apparatus including: a substrate holding unit that holds a substrate; a pressure regulator that regulates a pressure of a gas supplied into an elastic membrane; and a controller that controls the pressure regulator to make the pressure of the gas supplied into the elastic membrane variable in order to separate the substrate from the elastic membrane.

8 Claims, 8 Drawing Sheets

T1

| FILM TYPE OF WAFER | RECIPE |
|---|---|
| Th-SiO2 | FIRST PRESSURE PS1: 0.5MPa<br>SECOND PRESSURE PS2: 0.1MPa |
| PE-SiO2 | FIRST PRESSURE PS1: 0.4MPa<br>SECOND PRESSURE PS2: 0.05MPa |
| ⋮ | ⋮ |

(56) References Cited

U.S. PATENT DOCUMENTS

| | | | | |
|---|---|---|---|---|
| 2015/0241866 | A1* | 8/2015 | Takeda | G05B 19/4184 700/121 |
| 2015/0273650 | A1* | 10/2015 | Namiki | B24B 37/015 451/5 |
| 2017/0173756 | A1* | 6/2017 | Yamaki | B24B 37/005 |
| 2017/0266778 | A1* | 9/2017 | Kamata | B24B 37/107 |
| 2017/0266779 | A1* | 9/2017 | Isono | B24B 37/042 |
| 2017/0291274 | A1* | 10/2017 | Shinozaki | B24B 37/005 |

* cited by examiner

FIG.4
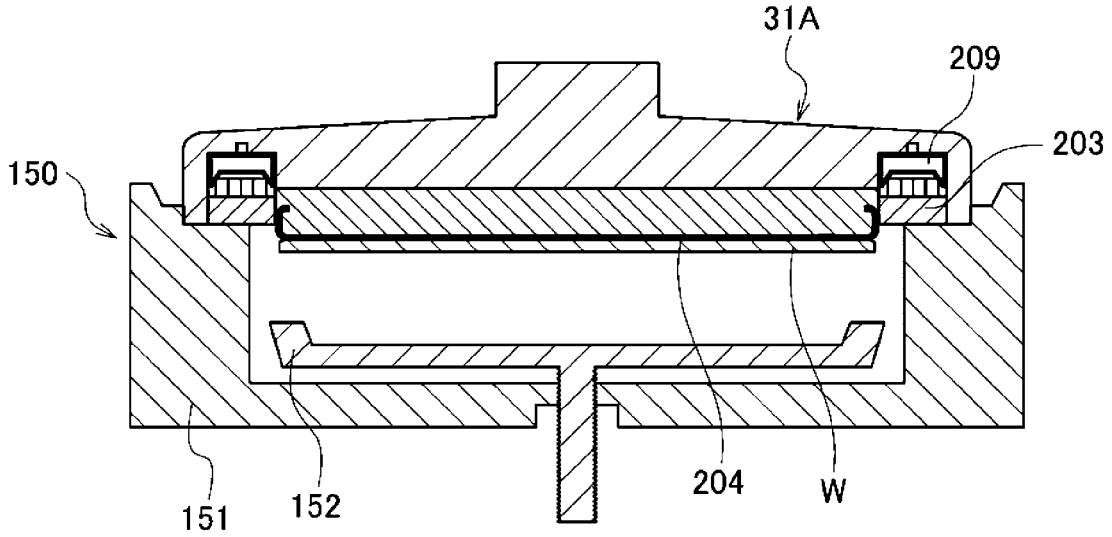
FIG.5
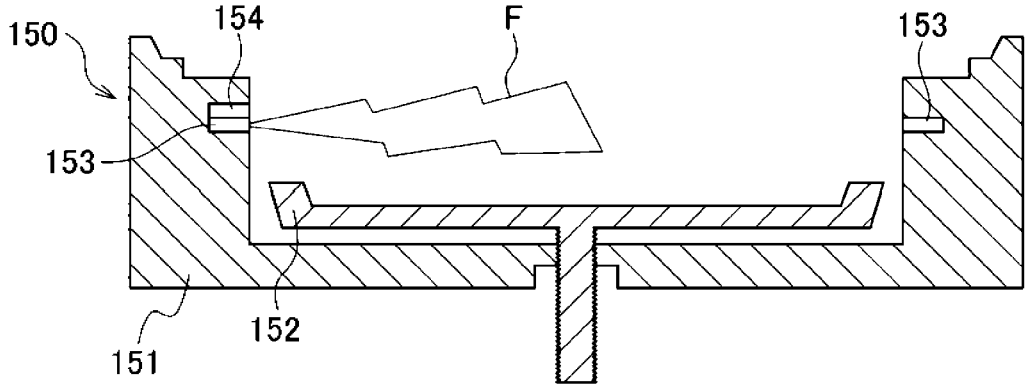
FIG.6
T1
| FILM TYPE OF WAFER | RECIPE |
|---|---|
| Th-SiO2 | FIRST PRESSURE PS1: 0.5MPa<br>SECOND PRESSURE PS2: 0.1MPa |
| PE-SiO2 | FIRST PRESSURE PS1: 0.4MPa<br>SECOND PRESSURE PS2: 0.05MPa |
| ⋮ | ⋮ |

SUBSTRATE PROCESSING APPARATUS

CROSS-REFERENCE TO RELATED APPLICATIONS

This application is based on and claims priority from Japanese Patent Application No. 2016-076569, filed on Apr. 6, 2016, with the Japan Patent Office, the disclosure of which is incorporated herein in its entirety by reference.

TECHNICAL FIELD

The present disclosure relates to a substrate processing apparatus.

BACKGROUND

In a substrate processing apparatus (e.g., a chemical mechanical polishing (CMP) apparatus), a substrate (e.g., a wafer) adsorbed to an elastic membrane (also referred to as a "membrane") of a substrate holding unit (also referred to as a "top ring") is separated from the elastic membrane by supplying a gas (e.g., nitrogen) having a predetermined pressure into the elastic membrane (see, e.g., Japanese Laid-Open Patent Publication No. 2011-258639).

SUMMARY

A substrate processing apparatus according to a first aspect of the present disclosure includes: a substrate holding unit that holds a substrate; a pressure regulator that regulates a pressure of a gas supplied into an elastic membrane of the substrate holding unit; and a controller that controls the pressure regulator to make the pressure of the gas supplied into the elastic membrane variable in order to separate the substrate from the elastic membrane.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 4 is a view illustrating an outline of the top ring and a substrate delivery device (pusher).

FIG. 5 is a view schematically illustrating a detailed structure of the pusher.

FIG. 6 is an exemplary table stored in a storage unit.

DETAILED DESCRIPTION

Figure 1:
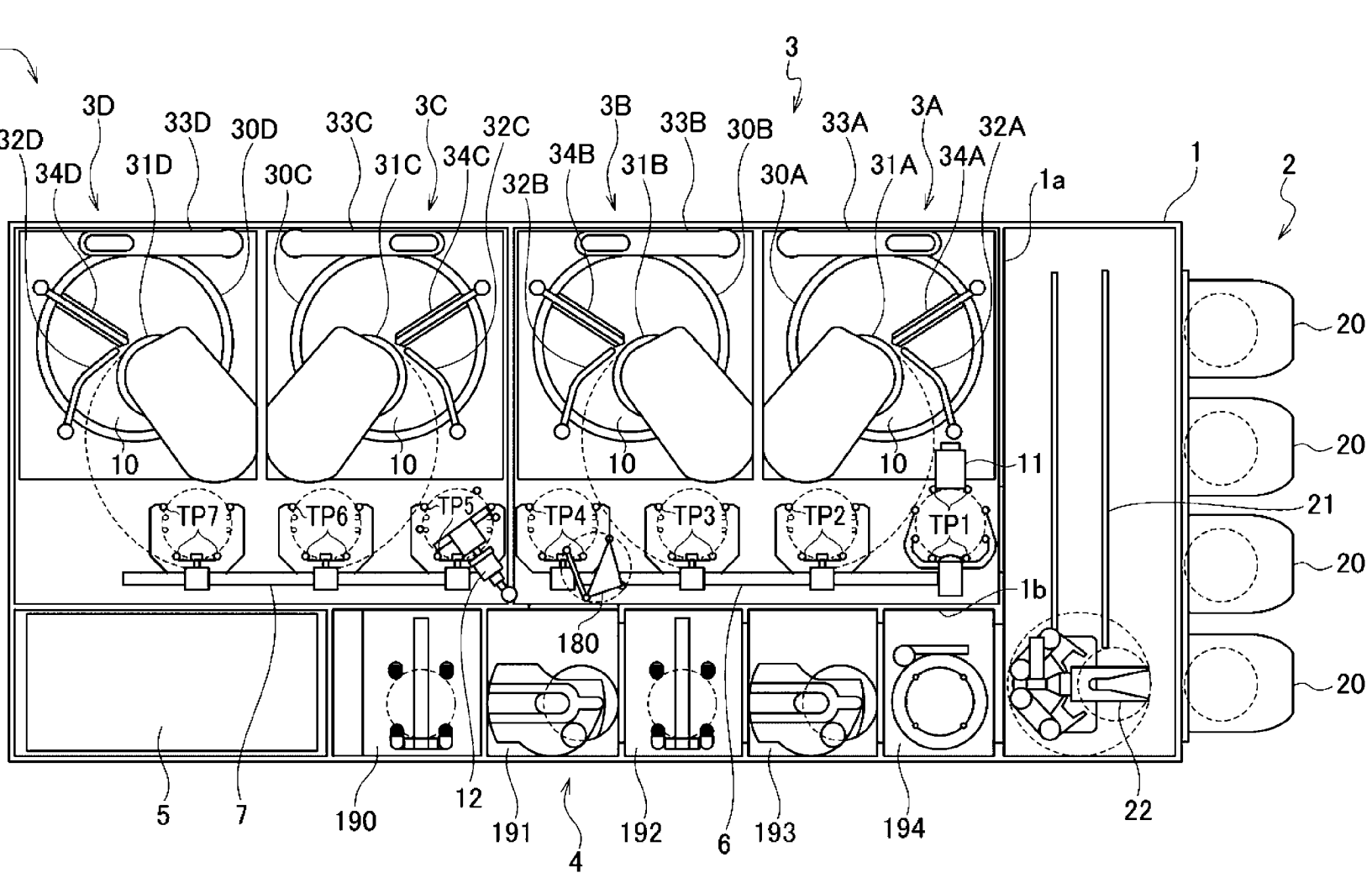
FIG. 1 is a plan view illustrating an entire configuration of a substrate processing apparatus according to an exemplary embodiment of the present disclosure.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Since the attachment force of a substrate to an elastic membrane is different depending on a type (e.g., a film type) of the substrate, there is a problem in that time required for the substrate to be separated from the elastic membrane (hereinafter, also referred to as a "substrate release time") is different depending on a type of the substrate. In some cases, the substrate may not be detached from the elastic membrane. Further, when the attachment force of the substrate to the elastic membrane is strong, there is a problem in that the substrate is not separated even when the elastic membrane is inflated, and a physical stress is applied to the substrate. In some cases, the substrate may be broken due to the physical stress.

The present disclosure has been made in consideration of the foregoing problems, and provides a substrate processing apparatus in which the variation of the time required for the substrate to be separated from the elastic membrane may be reduced.

A substrate processing apparatus according to a first aspect of the present disclosure includes: a substrate holding unit that holds a substrate; a pressure regulator that regulates a pressure of a gas supplied into an elastic membrane of the substrate holding unit; and a controller that controls the pressure regulator to make the pressure of the gas supplied into the elastic membrane variable in order to separate the substrate from the elastic membrane.

According to this configuration, the elastic membrane may be inflated at a speed corresponding to the attachment force of the substrate to the elastic membrane, by making the pressure inside the elastic membrane variable so as to control the inflating speed of the elastic membrane. Therefore, the variation of the substrate release time may be reduced, regardless of the attachment force of the substrate to the elastic membrane. Further, since the pressure inside the elastic membrane may be made variable and changed to an appropriate pressure corresponding to the substrate, the stress applied to the substrate may be reduced.

According to a second aspect of the present disclosure, in the substrate processing apparatus according to the first aspect of the present disclosure, the controller controls the pressure of the gas supplied into the elastic membrane according to a type of a substrate currently held by the substrate holding unit.

According to this configuration, while the inflation time of the elastic membrane is different depending on a difference in the attachment force of the substrate, the inflation time may be made uniform by setting an optimum pressure for each of different types of substrates to control an inflation extent of the elastic membrane. Therefore, the variation of the substrate release time depending on a type of a substrate may be reduced.

According to a third aspect of the present disclosure, in the substrate processing apparatus according to the second aspect of the present disclosure, the type of the substrate is a film type of a substrate, and the controller controls the pressure of the gas supplied into the elastic membrane according to a film type of a substrate currently held by the substrate holding unit.

According to this configuration, while the inflation time of the elastic membrane is different depending on a difference in the attachment force of the substrate, the inflation time may be made uniform by setting an optimum pressure for each of different types of substrates to control an inflation extent of the elastic membrane. Therefore, the variation of the substrate release time depending on a film type of a substrate may be reduced.

According to a fourth aspect of the present disclosure, in the substrate processing apparatus according to one of the first to third aspects of the present disclosure, the controller changes the pressure of the gas in stages.

According to this configuration, even when the attachment force of the substrate to the elastic membrane is strong, the physical stress to the substrate may be reduced by changing the pressure of the gas in stages. Further, the variation of the substrate release time may be reduced by changing the pressure of the gas in stages.

According to a fifth aspect of the present disclosure, the substrate processing apparatus according to the fourth aspect of the present disclosure further includes: a release nozzle that is capable of ejecting a pressurizing fluid; and a position detector that detects a position of a substrate adsorbed to the elastic membrane. When the position of the substrate reaches a position where the release nozzle is capable of ejecting the pressurizing fluid to the back surface of the substrate, the controller changes the pressure of the gas.

According to this configuration, since a substrate release pressure may be set to an optimum pressure at a timing when the release nozzle ejects the pressurizing fluid, the release performance of the substrate may be made satisfactory.

According to a sixth aspect of the present disclosure, in the substrate processing apparatus according to the fifth aspect of the present disclosure, the controller performs a control to supply the gas into the elastic membrane at a first pressure before the position of the substrate reaches a position where the release nozzle is capable of ejecting the pressurizing fluid to the back surface of the substrate, and performs a control to supply the gas into the elastic membrane at a second pressure lower than the first pressure when the position of the substrate reaches a position where the release nozzle is capable of ejecting the pressurizing fluid to the back surface of the substrate.

According to this configuration, the stress to the substrate may be reduced by lowering the substrate release pressure at the timing when the release nozzle ejects the pressurizing fluid.

According to a seventh aspect of the present disclosure, in the substrate processing apparatus according to the sixth aspect of the present disclosure, the position detector detects a height of the back surface of the substrate adsorbed to the elastic membrane as the position of the substrate, and the controller performs a control to supply the gas into the elastic membrane at the first pressure when the height of the back surface of the substrate that is detected by the position detector is equal to or higher than a height of an ejection port of the release nozzle, and performs a control to supply the gas into the elastic membrane at the second pressure lower than the first pressure when the height of the back surface of the substrate that is detected by the position detector becomes higher than the height of the ejection port of the release nozzle and to eject the pressurizing fluid from the release nozzle toward the back surface of the substrate.

According to this configuration, since the substrate release pressure may be lowered at the timing when the release nozzle ejects the pressurizing fluid, the stress to the substrate may be reduced.

According to an eighth aspect of the present disclosure, in the substrate processing apparatus according to one of the first to seventh aspects of the present disclosure, the controller changes the pressure of the gas according to an inflation rate of the elastic membrane.

According to this configuration, when the inflation rate of the elastic membrane is slow, the pressure of the gas may be increased, and the substrate release time may be made uniform.

According to a ninth aspect of the present disclosure, in the substrate processing apparatus according to one of the first to eighth aspects of the present disclosure, the pressure regulator is an electropneumatic regulator.

According to this configuration, the pressure supplied into the elastic membrane may be made variable.

According to the present disclosure, the elastic membrane may be inflated at a speed corresponding to the attachment force of the substrate to the elastic membrane by making the pressure inside the elastic membrane variable so as to control the inflating speed of the elastic membrane. Therefore, the inflation of the elastic membrane may be made fast by increasing the pressure of the gas supplied into the elastic membrane as the attachment force of the substrate to the elastic membrane is strong so that the variation of the substrate release time may be reduced, regardless of the attachment force of the substrate to the elastic membrane.

Hereinafter, the present exemplary embodiment will be described with reference to the drawings. A substrate processing apparatus 100 according to the present exemplary embodiment is, for example, a polishing apparatus for polishing a substrate. In the present exemplary embodiment, a wafer will be described as an example of the substrate. FIG. 1 is a plan view illustrating an entire configuration of the substrate processing apparatus 100 according to an exemplary embodiment of the present disclosure. As illustrated in FIG. 1, the substrate processing apparatus 100 includes a substantially rectangular housing 1, and the inside of the housing 1 is partitioned by partition walls 1*a* and 1*b* into a load/unload section 2, a polishing section 3, and a cleaning section 4. Each of the load/unload section 2, the polishing section 3, and the cleaning section 4 is independently assembled and exhausted. Further, the substrate processing apparatus 100 includes a controller 5 that controls a substrate processing operation.

The load/unload section 2 includes two or more (four in the present exemplary embodiment) front load units 20 on which wafer cassettes each stocking a plurality of wafers (substrates) therein are placed. The front load units 20 are disposed adjacent to the housing 1 and arranged along the width direction of the substrate processing apparatus 100 (along the direction vertical to the longitudinal direction of the substrate processing apparatus 100). Each front load unit 20 is configured to mount an open cassette, a standard manufacturing interface (SMIF) pod, or a front opening unified pod (FOUP) thereon. Here, the SMIF or the FOUP is a sealed container that accommodates a wafer cassette therein and is covered by partition walls so as to keep an independent environment from the outside space.

In addition, in the load/unload section 2, a traveling mechanism 21 is laid along the arrangement of the front load units 20, and a transport robot (loader) 22 is installed on the traveling mechanism 21 to be movable along the direction of the arrangement of the wafer cassettes. The transport robot 22 may access the wafer cassettes mounted on the front load units 20 by moving on the traveling mechanism 21. The transport robot 22 is provided with two upper and lower hands and selectively uses the upper and lower hands by using the upper hand when a processed wafer is returned to a wafer cassette and the lower hand when an unprocessed wafer is taken out of a wafer cassette. In addition, the lower hand of the transport robot 22 is configured to be able to reverse a wafer by rotating around an axis thereof.

Since the load/unload section 2 is a region which needs to be kept in the cleanest state, the inside of the load/unload section 2 is always kept at a pressure higher than that in any of the outside of the substrate processing apparatus 100, the polishing section 3, and the cleaning section 4. The polishing section 3 is the dirtiest region because slurry is used as a polishing liquid. Accordingly, a negative pressure is formed inside the polishing section 3 and is kept lower than the pressure inside the cleaning section 4. A filter fan unit (not illustrated) having a clean air filter such as, for example, a HEPA filter, a ULPA filter, or a chemical filter is provided in the load/unload section 2, and clean air from which particles, toxic vapor, or a toxic gas has been removed is always blown out from the filter fan unit.

The polishing section 3 is a region where polishing (flattening) of a wafer is performed and includes a first polishing unit 3A, a second polishing unit 3B, a third polishing unit 3C, and a fourth polishing unit 3D. As illustrated in FIG. 1, the first polishing unit 3A, the second polishing unit 3B, the third polishing unit 3C, and the fourth polishing unit 3D are arranged along the longitudinal direction of the substrate processing apparatus 100.

As illustrated in FIG. 1, the first polishing unit 3A includes a polishing table 30A to which a polishing pad 10 having a polishing surface is attached, a top ring (a substrate holding unit) 31A that holds a wafer and polishes the wafer while pressing the wafer against the polishing pad 10 on the polishing table 30A, a polishing liquid supply nozzle 32A that supplies a polishing liquid or a dressing liquid (e.g., deionized water) to the polishing pad 10, a dresser 33A that performs a dressing of the polishing surface of the polishing pad 10, and an atomizer 34A that ejects a mixed fluid of a liquid (e.g., deionized water) and a gas (e.g., nitrogen gas) or a mist form of a liquid (e.g., deionized water) to the polishing surface.

Likewise, the second polishing unit 3B includes a polishing table 30B to which a polishing pad 10 is attached, a top ring (a substrate holding unit) 31B, a polishing liquid supply nozzle 32B, a dresser 33B, and an atomizer 34B. The third polishing unit 3C includes a polishing table 30C to which a polishing pad 10 is attached, a top ring (a substrate holding unit) 31C, a polishing liquid supply nozzle 32C, a dresser 33C, and an atomizer 34C. The fourth polishing unit 3D includes a polishing table 30D to which a polishing pad 10 is attached, a top ring (a substrate holding unit) 31D, a polishing liquid supply nozzle 32D, a dresser 33D, and an atomizer 34D.

Next, a transport mechanism for transporting a wafer will be described. As illustrated in FIG. 1, a first linear transporter 6 is disposed adjacent to the first polishing unit 3A and the second polishing unit 3B. The first linear transporter 6 is a mechanism that transports a wafer among four transport positions (referred to as a "first transport position TP1," a "second transport position TP2," a "third transport position TP3," and a "fourth transport position TP4" in this order from the side of the load/unload section) arranged along the arrangement direction of the first polishing unit 3A and the second polishing unit 3B.

In addition, a second linear transporter 7 is disposed adjacent to the third polishing unit 3C and the fourth polishing unit 3D. The second linear transporter 7 is a mechanism that transports a wafer among four transport positions (referred to as a "fifth transport position TP5," a "sixth transport position TP6," and a "seventh transport position TP7" in this order from the side of the load/unload section) arranged along the arrangement direction of the third polishing unit 3C and the fourth polishing unit 3D.

A wafer is transported to the first polishing unit 3A and the second polishing unit 3B by the first linear transporter 6. As described above, the top ring 31A of the first polishing unit 3A moves between a polishing position and the second transport position TP2 by a swing operation of a top ring head 60. Accordingly, the delivery of a wafer to the top ring 31A is performed at the second transport position TP2. Likewise, the top ring 31B of the second polishing unit 3B moves between a polishing position and the third transport position TP3, and the delivery of a wafer to the top ring 31B is performed at the third transport position TP3. The top ring 31C of the third polishing unit 3C moves between a polishing position and the sixth transport position TP6, and the delivery of a wafer to the top ring 31C is performed at the sixth transport position TP6. The top ring 31D of the fourth polishing unit 3D moves between a polishing position and the seventh transport position TP7, and the delivery of a wafer to the top ring 31D is performed at the seventh transport position TP7.

A lifter 11 is disposed at the first transport position TP1 to receive a wafer from the transport robot 22. The wafer is delivered from the transport robot 22 to the first linear transporter 6 through the lifter 11. A shutter (not illustrated) is installed in the partition wall 1*a* between the lifter 11 and the transport robot 22. The shutter is opened when a wafer is transported such that the wafer is delivered from the transport robot 22 to the lifter 11. In addition, a swing transporter 12 is disposed among the first linear transporter 6, the second linear transporter 7, and the cleaning section 4. The swing transporter 12 has a hand that is movable between the fourth transport position TP4 and the fifth transport position TP5, and the delivery of a wafer from the first linear transporter 6 to the second linear transporter 7 is performed by the swing transporter 12. A wafer is transported to the third polishing unit 3C and/or the fourth polishing unit 3D by the second linear transporter 7. In addition, a wafer polished in the polishing section 3 is transported to the cleaning section 4 via the swing transporter 12.

Since the first polishing unit 3A, the second polishing unit 3B, the third polishing unit 3C, and the fourth polishing unit 3D have the same configuration, the first polishing unit 3A will be described hereinafter.

Figure 2:
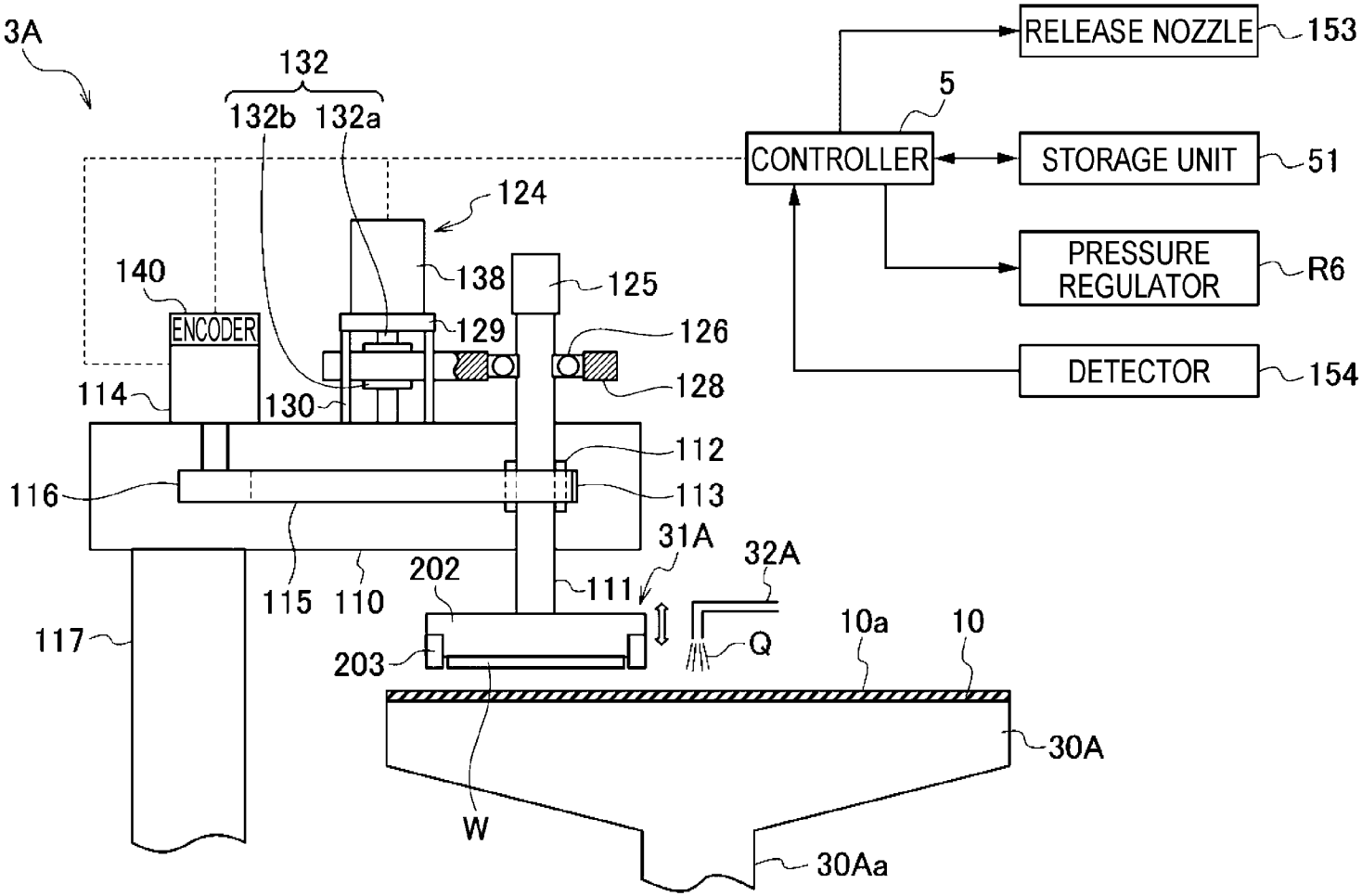
FIG. 2 is a view schematically illustrating a configuration of a first polishing unit according to the exemplary embodiment.

FIG. 2 is a view schematically illustrating a configuration of the first polishing unit 3A according to the present exemplary embodiment. As illustrated in FIG. 2, the first polishing unit 3A includes the polishing table 30A and the top ring 31A that holds a substrate (e.g., a wafer) as an object to be polished and presses the substrate against the polishing surface on the polishing table.

The polishing table 30A is connected to a motor (not illustrated) disposed below the polishing table 30A via a table axis 30Aa and is rotatable around the table axis 30Aa. The polishing pad 10 adheres to the top surface of the polishing table 30A, and a polishing surface 10*a* of the polishing pad 10 constitutes the polishing surface for polishing a wafer W. The polishing liquid supply nozzle 102 is provided above the polishing table 30A, and a polishing liquid Q is supplied onto the polishing pad 10 on the polishing table 30A through the polishing liquid supply nozzle 102.

The top ring 31A basically includes a top ring body 202 that presses a wafer W against the polishing surface 10*a* and a retainer ring 203 that holds the outer peripheral edge of the wafer W so as to suppress the wafer W from escaping from the top ring.

The top ring 31A is connected to a top ring shaft 111, and the top ring shaft 111 is configured to be movable vertically with respect to the top ring head 110 by an up-and-down movement mechanism 124. By the up-and-down movement of the top ring shaft 111, the entire top ring 31A is moved vertically with respect to the top ring head 110 so as to be positioned. In addition, a rotary joint 125 is attached to the top end of the top ring shaft 111.

The up-and-down movement mechanism 124 that moves the top ring shaft 111 and the top ring 31A upward and downward includes a bridge 128 that rotatably supports the top ring shaft 111 via a bearing 126, a ball screw 132 attached to the bridge 128, a support table 129 supported by a support column 130, and a servomotor 138 provided on the support table 129. The support table 129 supporting the servomotor 138 is fixed to the top ring head 110 via the support column 129.

The ball screw 132 includes a screw shaft 132*a* connected to the servomotor 138 and a nut 132*b* to which the screw shaft 132*a* is screw-connected. The top ring shaft 111 is configured to move upward and downward integrally with the bridge 128. Accordingly, when the servomotor 138 is driven, the bridge 128 moves upward and downward through the ball screw 132, and as a result, the top ring shaft 111 and the top ring 31A move upward and downward.

In addition, the top ring shaft 111 is connected to a rotary cylinder 112 via a key (not illustrated). The rotary cylinder 112 is provided with a timing pulley 113 on the outer peripheral portion thereof. A top ring rotation motor 114 is fixed to the top ring head 110, and the timing pulley 113 is connected to a timing pulley 116 provided on the top ring rotation motor 114 via a timing belt 115. Accordingly, when the top ring rotation motor 114 is driven and rotated, the rotary cylinder 112 and the top ring shaft 111 are integrally rotated via the timing pulley 116, the timing belt 115, and the timing pulley 113, and the top ring 31A is rotated. The top ring rotation motor 114 includes an encoder 140. The encoder 140 has a function to detect a rotation angle position of the top ring 31A or a function to integrate the number of rotations of the top ring 31A. In addition, a sensor for detecting a rotation angle "reference position (0 degree)" of the top ring 31A may be separately provided. In addition, the top ring head 110 is supported by a top ring head shaft 117 rotatably supported to a frame (not illustrated).

The controller 5 controls the respective devices including the top ring rotation motor 114, the servomotor 138, and the encoder 140, in the apparatus. The storage unit 51 is connected to the controller 5 via a wire, and the controller 5 may refer to the storage unit 51.

In the first polishing unit 3A configured as illustrated in FIG. 2, the top ring 31A is configured to hold a substrate such as, for example, a wafer W on the lower surface thereof. The top ring head 110 is configured to be pivotable about the top ring head shaft 117. By the pivoting of the top ring head 110, the top ring 31A holding a wafer W on the lower surface thereof is moved from the position for receiving the wafer W to a position above the polishing table 30A. Then, the top ring 31A is moved downward to press the wafer W against the front surface (the polishing surface) 10*a* of the polishing pad 10. At this time, the top ring 31A and the polishing table 30A are individually rotated, and a polishing liquid is supplied onto the polishing pad 10 from the polishing liquid supply nozzle 32A provided above the polishing table 30A. In this way, the wafer W is brought into a sliding contact with the polishing surface 10*a* of the polishing pad 10 so as to polish the front surface of the wafer W.

Figure 3:
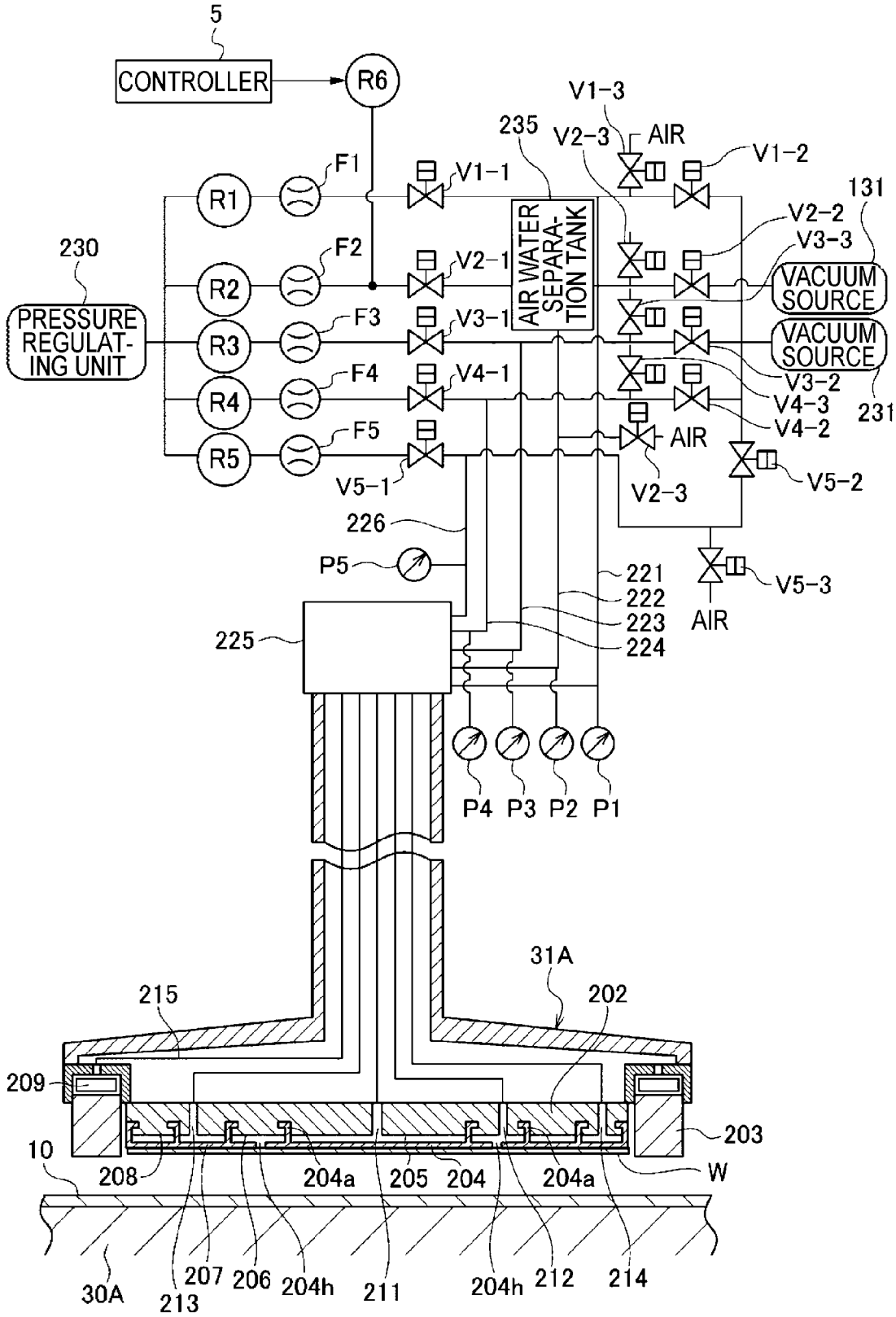
FIG. 3 is a sectional view schematically illustrating a top ring constituting a substrate holding device that holds a wafer W as an object to be polished and presses the wafer W against a polishing surface on a polishing table.

Next, the top ring (the substrate holding unit) in the polishing apparatus of the present disclosure will be described. FIG. 3 is a sectional view schematically illustrating the top ring 31A constituting a substrate holding apparatus that holds a wafer W as an object to be polished and presses the wafer W against the polishing surface on the polishing table. FIG. 3 illustrates only the main components constituting the top ring 31A.

As illustrated in FIG. 3, the top ring 31A basically includes a top ring body (also referred to as a "carrier") 202 that presses a wafer W against the polishing surface 10*a*, and a retainer ring 203 that directly presses the polishing surface 10*a*. The top ring body (carrier) 202 is formed by a substantially disc-shaped member, and the retainer ring 203 is attached to the outer peripheral portion of the top ring body 202. The top ring body 202 is made of a resin such as, for example, an engineering plastic (e.g., PEEK). An elastic membrane (membrane) 204 is attached to the lower surface of the top ring body 202 to be in contact with the back surface of the wafer. The elastic membrane (membrane) 204 is made of a rubber material having excellent strength and durability such as, for example, an ethylene propylene rubber (EPDM), a polyurethane rubber, or a silicone rubber.

The elastic membrane (membrane) 204 has a plurality of concentric partition walls 204*a*. By the partition walls 204*a*, a circular center chamber 205, an annular ripple chamber 206, an annular outer chamber 207, and an annular edge chamber 208 are formed between the upper surface of the elastic membrane 204 and the lower surface of the top ring body 202. That is, the center chamber 205 is formed at the center of the top ring body 202, and the ripple chamber 206, the outer chamber 207, and the edge chamber 208 are formed concentrically in this order from the center of the top ring body 202 toward the outer peripheral direction thereof. The elastic membrane (membrane) 204 has a plurality of holes 204*h* penetrating the elastic membrane 204 for adsorbing the wafer in the thickness direction of the elastic membrane 204, in the ripple area (the ripple chamber 206). In the present exemplary embodiment, the holes 204*h* are formed in the ripple area. However, the holes 204*h* may be formed an area other than the ripple area.

A flow path 211, a flow path 212, a flow path 213, and a flow path 214 are formed inside the top ring body 202 to communicate with the center chamber 205, the ripple chamber 206, the outer chamber 207, and the edge chamber 208, respectively. The flow path 211 that communicates with the center chamber 205, the flow path 213 that communicates with the outer chamber 207, and the flow path 214 that communicates with the edge chamber 208 are connected to flow paths 221, 223, and 224, respectively, via a rotary joint 225. The flow paths 221, 223, and 224 are connected to a pressure regulating unit 230 via valves V1-1, V3-1, and V4-1 and pressure regulators R1, R3, and R4, respectively.

In addition, the flow paths 221, 223, and 224 are connected to a vacuum source 231 via valves V1-2, V3-2, and V4-2, respectively, and may communicate with the air via valves V1-3, V3-3, and V4-3, respectively.

Meanwhile, the flow path 212 that communicates with the ripple chamber 206 is connected to a flow path 222 via the rotary joint 225. The flow path 222 is connected to the pressure regulating unit 230 via an air water separation tank 235, the valve V2-1, and the pressure regulator R2. In addition, the flow path 222 is connected to the vacuum source 131 via the air water separation tank 235 and a valve V2-2 and may communicate with the air via a valve V2-3. In addition, the flow path 222 is connected to the pressure regulator R6 via the air water separation tank 235 and a valve V2-1. The pressure regulator R6 is, for example, an electropneumatic regulator. Accordingly, the pressure supplied into the membrane 204 may be made variable. The pressure regulator R6 is connected to the controller 5 via a control line, and the controller 5 controls the pressure regulator R6 to make the pressure of a gas supplied into the membrane 204 variable. As described above, the pressure regulator R6 communicates with the ripple chamber 206 via the flow path 222 and the flow path 212 and regulates the pressure of a gas (e.g., nitrogen) supplied to the ripple chamber 206 inside the membrane 204 of the top ring 31A.

Thus, the wafer W adsorbed to the membrane 204 may be separated by making the pressure inside the ripple chamber 206 in the membrane 204 variable to control the inflation of the membrane 204. Accordingly, the inflation of the membrane 204 may be controlled by making the pressure of a gas supplied into the membrane 204 variable according to the attachment force of the wafer W to the membrane 204, and the time required for the wafer W to be separated from the membrane 204 (hereinafter, also referred to as "wafer release time") may be stabilized. Further, since the pressure inside the elastic membrane is made variable and thus may be changed to an appropriate pressure according to the wafer W, the stress applied to the wafer W may be reduced.

In addition, a retainer ring pressurizing chamber 209 made of an elastic membrane is also formed directly above the retainer ring 20. The retainer ring pressurizing chamber 209 is connected to a flow path 226 via a flow path 215 formed inside the top ring body (carrier) 202 and the rotary joint 225. The flow path 226 is connected to the pressure regulating unit 230 via a valve V5-1 and a pressure regulator R5. In addition, the flow path 226 is connected to the vacuum source 231 via a valve V5-2 and may communicate with the air via a valve V5-3. The pressure regulators R1, R2, R3, R4, and R5 have a pressure regulating function to regulate the pressures of pressure fluids supplied to the center chamber 205, the ripple chamber 206, the outer chamber 207, the edge chamber 208, and the retainer ring pressurizing chamber 209, respectively, from the pressure regulating unit 230. Each of the pressure regulators R1, R2, R3, R4, and R5 and the valves V1-1 to V1-3, V2-1 to V2-3, V3-1 to V3-3, V4-1 to V4-3, and V5-1 to V5-3 is connected to the controller 5 (see FIGS. 1 and 2) so that the operation thereof is controlled. In addition, pressure sensors P1, P2, P3, P4, and P5 and flow sensors F1, F2, F3, F4, and F5 are installed in the flow paths 221, 222, 223, 224, and 226, respectively.

In the top ring 31A configured as illustrated in FIG. 3, as described above, the center chamber 205 is formed at the center of the top ring body 202, and the ripple chamber 206, the outer chamber 207, and the edge chamber 208 are formed concentrically in this order from the center of the top ring body 202 toward the outer peripheral direction thereof. The pressure of a fluid supplied to each of the center chamber 205, the ripple chamber 206, the outer chamber 207, the edge chamber 208, and the retainer ring pressurizing chamber 209 may be independently regulated by the pressure regulating unit 230 and the pressure regulators R1, R2, R3, R4, and R5. With this configuration, the pressing force for pressing the wafer W against the polishing pad 10 may be regulated for each area of the wafer W, and the pressing force of the retainer ring 203 for pressing the polishing pad 10 may be regulated.

Next, a series of polishing processes by the substrate processing apparatus 100 configured as illustrated FIGS. 1 to 3 will be described. The top ring 31A receives the wafer W from the first linear transporter 6 and holds the wafer W by vacuum adsorption. The plurality of holds 204*h* are formed in the elastic membrane (membrane) 204 to adsorb the wafer W by vacuum, and these holes 204*h* communicate with the vacuum source 131. The top ring 31A holding the wafer W by vacuum adsorption moves downward to a preset polishing time setting position of the top ring. At the polishing time setting position, the retainer ring 203 is in contact with the front surface (the polishing surface) 10*a* of the polishing pad 10. However, since the top ring 31A adsorbs and holds the wafer W before the polishing, a fine gap (e.g., about 1 mm) is formed between the front surface (the surface to be polished) of the wafer W and the front surface (the polishing surface) 10*a* of the polishing pad 10. At this time, the polishing table 30A and the top ring 31A are driven and rotated together with each other. In this state, by inflating the elastic membrane (membrane) 204 at the side of the back surface of the wafer and bringing the front surface (the surface to be polished) of the wafer into contact with the front surface (the polishing surface) of the polishing pad 10 so as to cause a relative movement between the polishing table 30A and the top ring 31A, the polishing is performed until the front surface (the surface to be polished) of the wafer W becomes a predetermined state (e.g., a predetermined film thickness).

After the process of processing the wafer on the polishing pad 10 is completed, the wafer W is adsorbed to the top ring 31A, and the top ring 31A is moved upward and moved to the substrate delivery device (also referred to as a "pusher") 150 of the first linear transporter (the substrate transport unit) 6. After the movement, a gas (e.g., nitrogen) is supplied into the ripple chamber 206 in the membrane 204 to inflate the membrane 204 to a predetermined extent thereby reducing the attachment area to the wafer W so that the wafer W is separated from the membrane 204 by the pressure of the gas. The predetermined extent is, for example, an extent to which the position of the wafer W reaches a position where the release nozzle is capable of ejecting a pressurizing fluid to the back surface of the wafer W as described later. When separating the wafer W from the membrane 204, the pressurizing fluid is ejected between the membrane 204 and the wafer W in the state where the elastic membrane is inflated to the predetermined extent. This assists the release of the wafer W so as to facilitate the separation of the wafer W. The detachment of the wafer W from the membrane 204 may be referred to as "wafer release." Hereinafter, the wafer release will be described in detail.

FIG. 4 is a view illustrating an outline of the top ring 31A and the substrate delivery device (pusher) 150. FIG. 4 is a view schematically illustrating a state where the pusher 150 has been moved upward in order to deliver the wafer W from the top ring 31A to the pusher 150. As illustrated in FIG. 3, the pusher 150 includes a top ring guide 151 that may be fitted with the outer peripheral surface of the top ring 31A in order to perform the centering between the top ring 31A and the pusher 150, a push stage 152 that supports the wafer when the wafer is delivered between the top ring 31A and the pusher 150, an air cylinder (not illustrated) that vertically moves the push stage 152, and an air cylinder (not illustrated) that vertically moves the push stage 152 and the top ring guide 151.

Hereinafter, the operation to deliver the wafer W from the top ring 31A to the pusher 150 will be described. After the process of processing the wafer on the polishing pad 10 is completed, the top ring 31A adsorbs the wafer W. The adsorption of the wafer W is performed by causing the holes 204*h* of the membrane 204 to communicate with the vacuum source 131. The top ring 31A has the membrane 204 having the surface formed with the holes 204*h* and adsorbs the wafer W to the surface of the membrane 204 by attracting the wafer W through the holes 204*h*.

After the adsorption of the wafer W, the top ring 31A is moved upward and moved to the pusher 150 to perform the detachment (release) of the wafer W. After the movement to the pusher 150, a cleaning operation may be performed by rotating the top ring 31A while supplying deionized water or a chemical liquid to the wafer W adsorbed to and held by the top ring 31A.

Thereafter, the push stage 152 and the top ring guide 151 of the pusher 150 are moved upward, and the top ring guide 151 is fitted with the outer peripheral surface of the top ring 31A to perform the centering between the top ring 31A and the pusher 150. At this time, the top ring guide 151 pushes up the retainer ring 203, and at the same time, the retainer ring pressurizing chamber 209 is evacuated so that the retainer ring 203 is promptly moved upward. When the upward movement of the pusher is completed, the lower surface of the retainer ring 203 is pressed against the upper surface of the top ring guide 151 and pushed up to the side higher than the lower surface of the membrane 204 so that the space between the wafer and the membrane is exposed. In the example illustrated in FIG. 4, the lower surface of the retainer ring 203 is positioned 1 mm higher than the lower surface of the membrane. Thereafter, the vacuum adsorption of the wafer W by the top ring 31A is stopped, and the wafer release operation is performed. In addition, instead of moving the pusher upward, the top ring may be moved downward to be placed in a desired positional relationship.

FIG. 5 is a view schematically illustrating the detailed structure of the pusher 150. As illustrated in FIG. 5, the pusher 150 includes the top ring guide 151, the push stage 152, and two release nozzles (substrate separation promoting units) 153 formed inside the top ring guide 151 and capable of injecting a pressurized fluid F. The pressurizing fluid F may be a pressurizing gas (e.g., pressurizing nitrogen) alone, a pressurizing liquid (e.g., pressurizing water) alone, or a mixed fluid of a pressurizing gas (e.g., pressurizing nitrogen) and a liquid (e.g., deionized water). The release nozzles 153 are connected to the controller 5 via a control line and controlled by the controller 5. Further, the pusher 150 includes a position detector 154 that detects a position of the wafer W adsorbed to the membrane 204. In the present exemplary embodiment, the position detector 154 detects, for example, the height of the back surface of the wafer W adsorbed to the membrane 204. The position detector 154 has, for example, a capturing unit that captures the inside of the top ring guide 151 and detects the height of the back surface of the wafer W from the captured image.

A plurality of release nozzles 153 are provided in the circumferential direction of the top ring guide 151 at predetermined intervals and adapted to eject the pressurizing fluid F toward the radially inward side of the top ring guide 151. As a result, a release shower formed of the pressurizing fluid F is injected between the wafer W and the membrane 204 so that the wafer release for detaching the wafer W from the membrane 204 may be performed.

The storage unit 51 stores a type of a wafer and a recipe of the pressure of a gas to be supplied into the membrane in association with each other. In the present exemplary embodiment, as illustrated in FIG. 6, the storage unit 51 stores, for example, a film type of a wafer and a recipe of the pressure of a gas to be supplied into the membrane in association with each other. FIG. 6 is an exemplary table T1 stored in the storage unit 51. The table T1 of FIG. 6 enumerates records of a set of a film type of a wafer and a recipe of the pressure of a gas to be supplied into the membrane. For example, when a film type of a wafer is Th—$SiO_2$, a first pressure PS1 may be set to 0.5 MPa, and a second pressure PS2 may be set to 0.1 MPa. In this manner, the first pressure PS1 and the second pressure PS2 may be set according to a film type of a wafer.

The controller 5 controls the pressure of a gas supplied to the membrane 204 according to a type of a wafer W currently held by the top ring 31A. Thus, although the inflation time of the membrane 204 is different depending on a difference in the attachment force of a wafer, the inflation time may be made uniform by setting an optimum pressure for each of different types of wafers so as to control the inflating extent of the membrane. Therefore, the variation of the wafer release time depending on a type of a wafer may be reduced. In the present exemplary embodiment, the controller 5 controls the pressure of a gas supplied to the membrane 204 according to, for example, a film type of a wafer W currently held by the top ring 31A. Thus, although the inflation time of the membrane 204 is different depending on a difference in the attachment force of a wafer, the inflation time may be made uniform by setting an optimum pressure for each of different film types of wafers so as to control the inflating extent of the membrane. Thus, the variation of the wafer release time depending on a film type of a wafer may be reduced. Specifically, the controller 5 controls the pressure of a gas supplied to the membrane 204 by using, for example, a recipe (e.g., the first pressure PS1 and the second pressure PS2) corresponding to a film type of the wafer W that is currently being held, with reference to the storage unit 51.

In addition, when the attachment force of the substrate to the elastic membrane is strong, there is a problem in that the substrate is not separated even when the elastic membrane is inflated, and a physical stress is applied to the substrate. Furthermore, the substrate may be broken due to the physical stress. In contrast, the controller 5 according to the present exemplary embodiment changes the pressure of a gas supplied to the membrane 204 in stages (e.g., with elapse of time). Accordingly, even when the attachment force of the substrate to the elastic membrane is strong, the physical stress to the substrate may be reduced by changing the pressure of the gas in stages. Further, the variation of the substrate release time may be reduced by changing the pressure of a gas in stages. In addition, when the position of the wafer W reaches a position where the release nozzles 153 are capable of ejecting the pressurizing fluid the back surface of the wafer W, the controller 5 changes the pressure of a gas supplied to the membrane 204. Accordingly, since a wafer release pressure may be set to an optimum pressure at the timing when the release nozzles 153 eject the pressurizing fluid, the release performance of the substrate may be made satisfactory.

The controller 5 controls the pressure of a gas supplied into the membrane 204 by using the position of the wafer W (e.g., the height of the back surface of the wafer W) detected by the position detector 154. In the present exemplary embodiment, for example, the controller 5 performs a control to supply a gas into the membrane 204 at the first pressure PS1 before the position of the wafer W reaches the position where the releaser nozzles 153 are capable of ejecting the pressurizing fluid to the back surface of the wafer. Meanwhile, when the position of the wafer W reaches the position where the release nozzles 153 are capable of ejecting the pressurizing fluid to the back surface of the wafer W, the controller 5 performs a control to supply the gas into the membrane 204 at the second pressure PS2 which is lower than the first pressure PS1. Further, the controller 5 performs a control to eject the pressurizing fluid from the release nozzles 153 toward the back surface of the wafer W.

According to this configuration, the wafer release pressure is reduced at the timing when the release nozzles 153 eject the pressurizing fluid so that the stress applied to the wafer W may be reduced.

Figure 7:
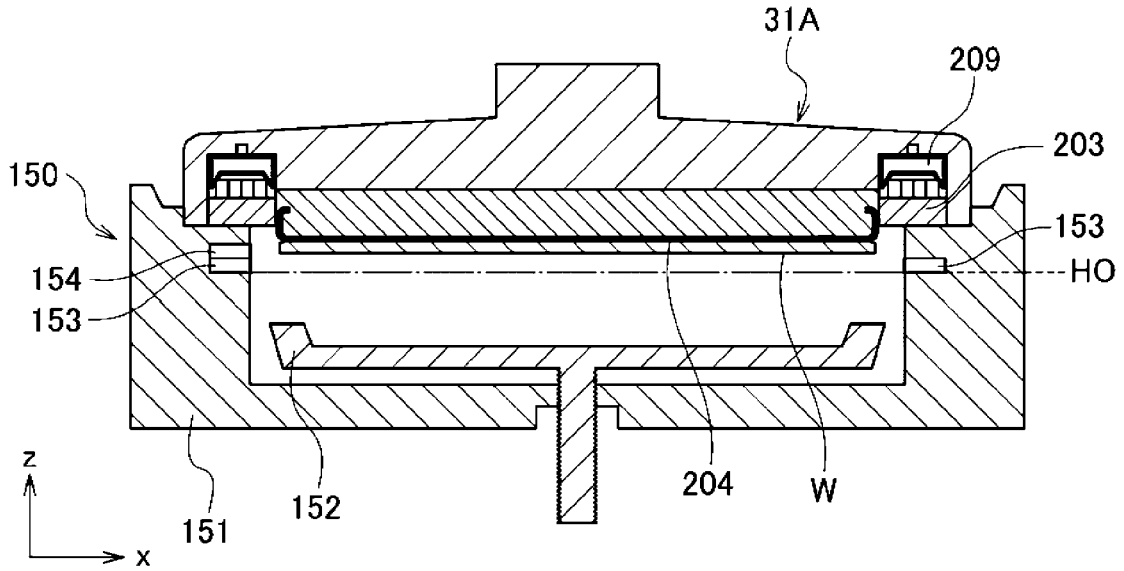
FIG. 7 is a view schematically illustrating a state before a wafer is detached from a membrane.

Next, a specific example of the process performed by the controller 5 for the above-described release of the wafer W will be described with reference to FIGS. 7 and 8. FIG. 7 is a view schematically illustrating a state before the wafer is detached from the membrane. As illustrated in FIG. 7, the upward movement of the pusher is completed, and the lower surface of the retainer ring 203 is pressed against the upper surface of the top ring guide 151 and pushed up to the side higher than the lower surface of the membrane 204 so that the space between the wafer and the membrane is exposed. In FIG. 7, the height of the back surface of the wafer W is higher than the height H0 of the ejection ports of the release nozzles.

As illustrated in FIG. 7, when the height of the back surface of the wafer W detected by the position detector 154 is equal to or higher than the height H0 of the ejection ports of the release nozzles 153, the controller 5 performs a control to supply a gas into the membrane 204 at the first pressure PS1. Accordingly, a gas is supplied into the ripple area (the ripple chamber) 206 inside the membrane 204 at the first pressure PS1.

Figure 8:
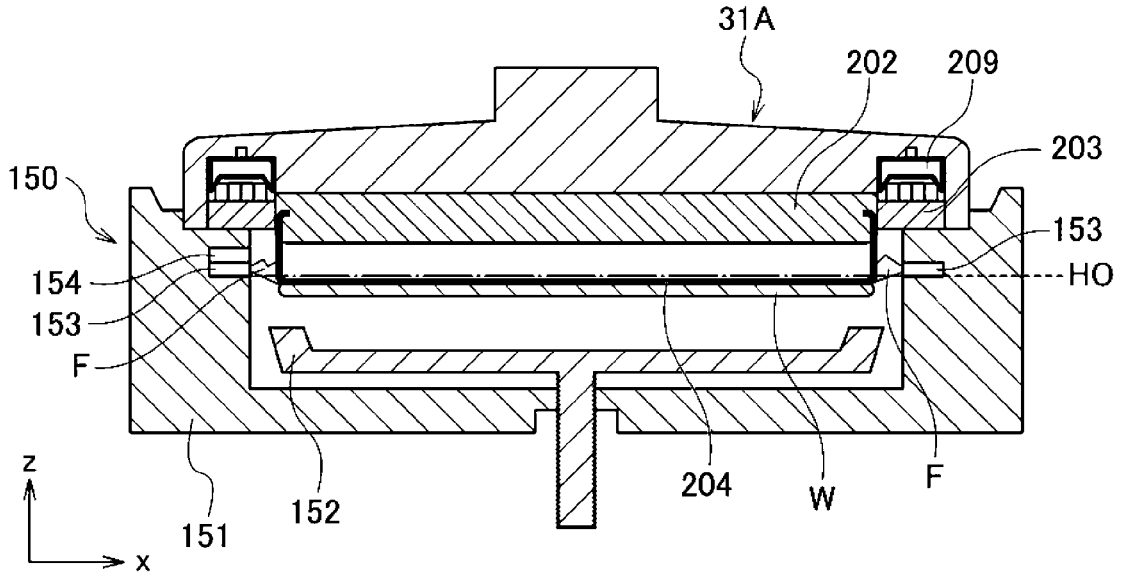
FIG. 8 is a view schematically illustrating a state at the wafer release time when a wafer is detached from a membrane.

FIG. 8 is a view schematically illustrating a state at the wafer release time when the wafer is detached from the membrane. In FIG. 8, the height of the back surface of the wafer W is lower than the height H0 of the ejection ports of the release nozzles. When the membrane 204 is inflated so that the height of the back surface of the wafer W detected by the position detector 169 becomes lower than the height H0 of the ejection ports of the release nozzles 153 as illustrated in FIG. 8, the controller 5 performs a control to supply a gas into the membrane 204 at the second pressure PS2 which is lower than the first pressure PS1. In addition, the controller 5 performs a control to eject the pressurizing fluid from the release nozzles 153 toward the back surface of the wafer W.

According to this configuration, since the wafer release pressure may be reduced at the timing when the release nozzles 153 eject the pressurizing fluid, the release performance of the wafer W may be made satisfactory.

Figure 9:
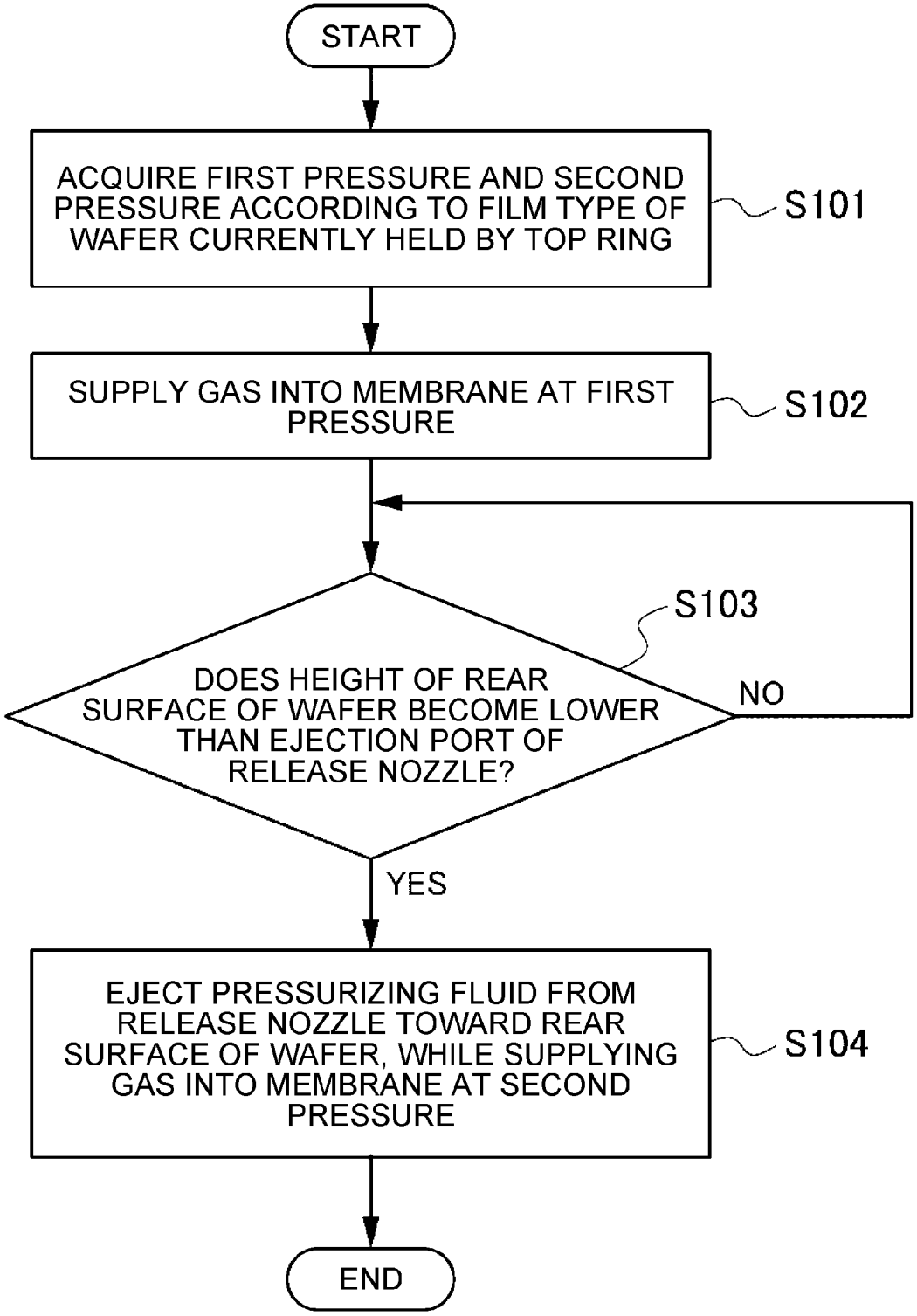
FIG. 9 is a flow chart illustrating an exemplary flow of a wafer release process according to the exemplary embodiment.

FIG. 9 is a flow chart illustrating an exemplary flow of the wafer release process according to the present exemplary embodiment.

(Step S101) Next, the controller 5 acquires the first pressure PS1 and the second pressure PS2 corresponding to a film type of the wafer W currently held by the top ring 31A.

(Step S102) Next, the controller 5 supplies a gas into the membrane 204 at the first pressure PS1.

(Step S103) Next, the controller 5 determines whether the height of the back surface of the wafer W becomes lower than the ejection ports of the release nozzles 153. The controller 5 stands by until the height of the back surface of the wafer W becomes lower than the ejection ports of the release nozzles 153.

(Step S104) When it is determined in step S103 that the height of the back surface of the wafer W becomes lower than the ejection ports of the release nozzles 153, the controller 5 supplies the gas into the membrane 204 at the second pressure PS2 and ejects the pressurizing fluid from the release nozzles 153 toward the back surface of the wafer W.

As described above, the substrate processing apparatus 100 according to the present exemplary embodiment includes the top ring 31A that has the membrane 204 provided with the holes 204*h* on the surface thereof, and adsorbs the wafer W to the surface of the membrane 204 by attracting the wafer W through the holes 204*h*. Further, the substrate processing apparatus 100 includes the pressure regulator R6 that regulates the pressure of a gas supplied into the membrane. Further, the substrate processing apparatus 100 includes the controller 5 that controls the pressure regulator R6 to make the pressure of the gas supplied into the membrane 204 variable in order to separate the wafer W from the membrane 204.

According to this configuration, the membrane 204 may be inflated at a speed corresponding to the attachment force of the wafer W to the membrane 204 by making the pressure inside the ripple chamber 206 in the membrane 204 variable so as to control the inflating speed of the membrane 204. Accordingly, as the attachment force of the wafer W to the membrane 204 is strong, the pressure of the gas supplied into the membrane 204 may be increased so as to accelerate the inflation of the membrane 204. Therefore, the variation of the wafer release time may be reduced, regardless of the attachment force of the wafer W to the membrane 204.

In addition, the controller 5 may change the pressure of the gas supplied into the membrane 204 according to an inflating rate of the membrane 204. Thus, when the inflating rate of the membrane 204 is slow, the pressure of the gas may be increased, and the wafer release time may be made uniform.

In addition, the position detector 154 may be positioned at the height equal to the release nozzles 153 and have a light projecting unit and a light receiving unit such that the light projecting unit irradiates light, and the light receiving unit detects the reflected light. In that case, when time required from the start of the light projection to the detection of the reflected light becomes shorter than set time, the controller 5 may determine that the position of the wafer W becomes the position where the release nozzles 153 are capable of ejecting the pressurizing fluid to the back surface of the wafer W.

In the present exemplary embodiment, the example where the substrate processing apparatus includes the pusher 150 has been described. However, the present disclosure is not limited thereto, and the substrate processing apparatus may not include the pusher 150. Instead, the first linear transporter 6 and the second linear transporter 7 may function as the pusher 150.

Figure 10:
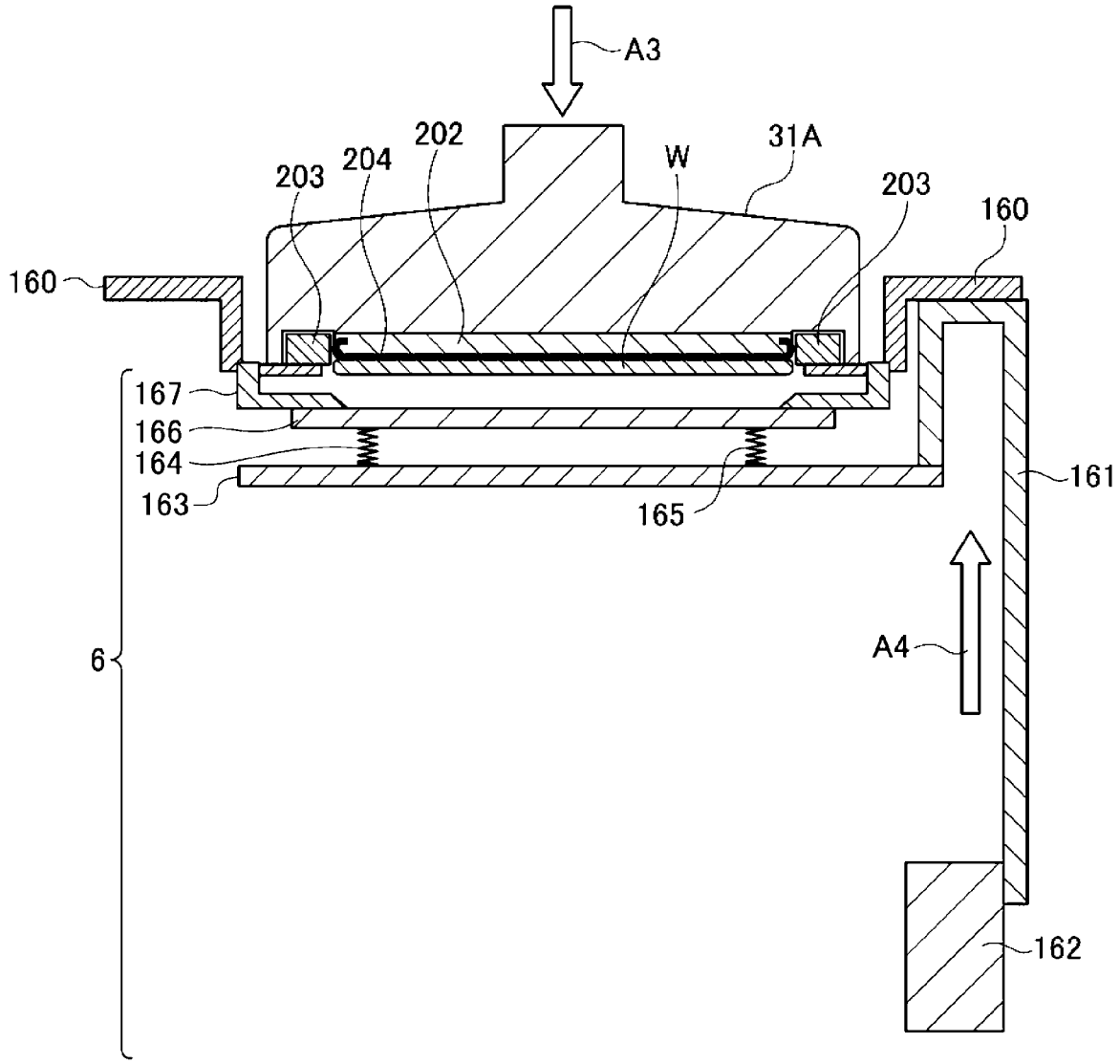
FIG. 10 is a sectional view schematically illustrating a top ring and a first linear transporter in a modification of the exemplary embodiment.

FIG. 10 is a sectional view schematically illustrating the top ring 31A and the first linear transporter 6 in a modification of the present exemplary embodiment. As illustrated in FIG. 10, the first linear transporter 6 includes a linear stage 160, a transport hand 161 that moves vertically, a holding unit 162 that holds the transport hand 161 to be movable vertically, a plate member 163 to which the transport hand 161 is connected, elastic members 164 and 165 of which one ends are connected to the front surface of the plate member 163, a plate member 166 having a back surface to which the other ends of the elastic members 164 and 165 are connected, and an annular member 167 provided on the plate member 166.

As illustrated in FIG. 10, when the wafer W is released, the top ring 31A first moves downward as indicated by the arrow A3, and the first linear transporter 6 moves upward as indicated by the arrow A4. Subsequently, when the first linear transporter 6 moves upward as indicated by the arrow A4, the annular member 167 of the first linear transporter 6 presses the linear stage 160. Accordingly, the linear stage 160 presses the retainer ring 203 of the top ring 31A, and as a result, the retainer ring 203 moves upward. The first linear transporter 6 stops at the wafer W delivery position.

Figure 11:
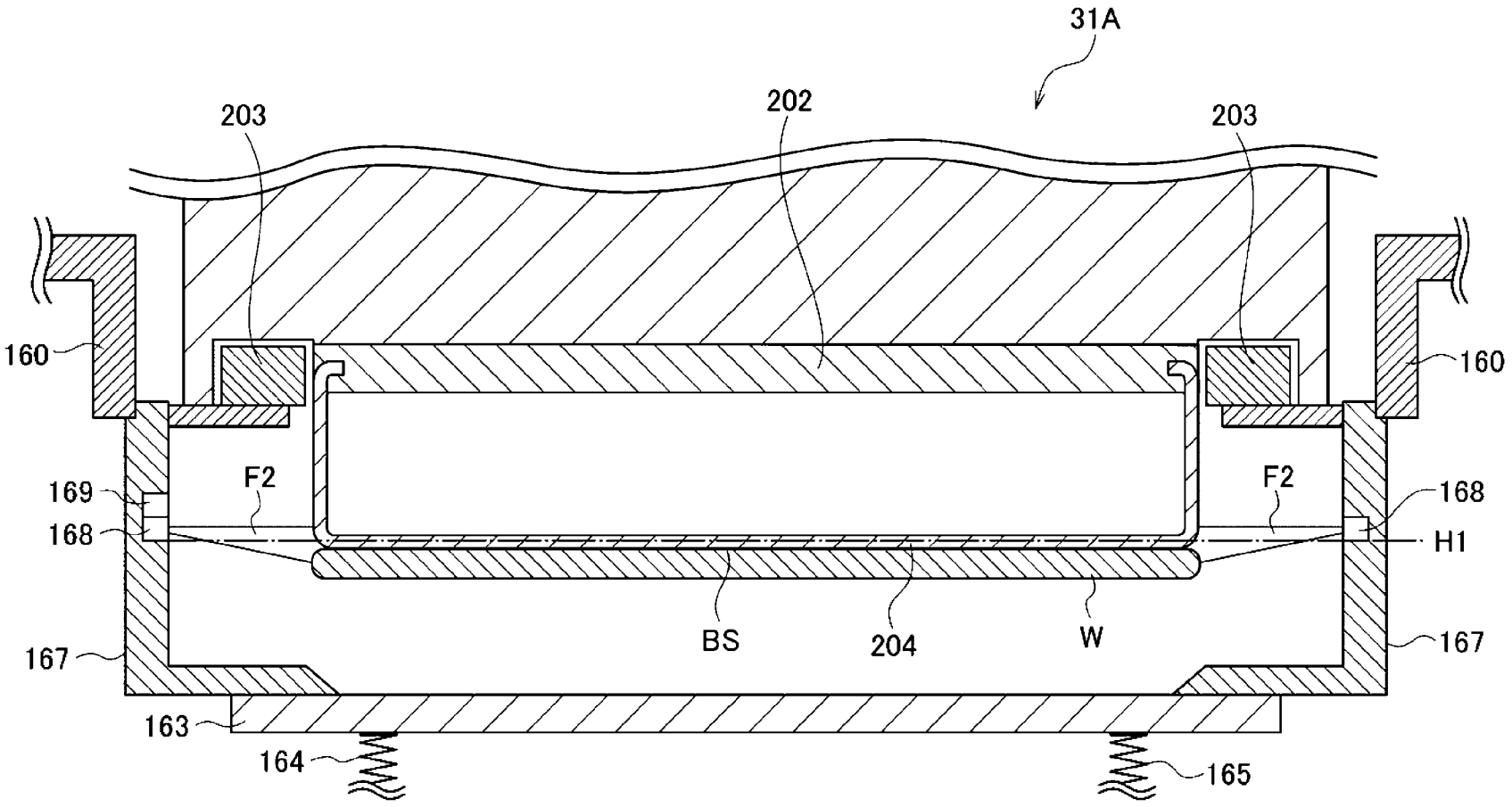
FIG. 11 is a partial sectional view schematically illustrating a state at the wafer release time when a wafer is detached from a membrane, in the modification of the exemplary embodiment.

FIG. 11 is a partial sectional view schematically illustrating a state at the wafer release time when the wafer is released from the membrane in the modification of the present exemplary embodiment. As illustrated in FIG. 11, release nozzles (substrate separation promoting units) 168 capable of injecting a pressurizing fluid are provided inside the annular member 167. A plurality of release nozzles 168 are provided in the circumferential direction of the annular member 167 at predetermined intervals and adapted to eject the pressurizing fluid F toward the radially inward side of the annular member 167. Accordingly, a release shower formed of the pressurizing fluid F is injected between the wafer W and the membrane 204, and the wafer release for detaching the wafer W from the membrane 204 may be performed. The pressurizing fluid F may be a pressurizing gas (e.g., pressurizing nitrogen) alone, a pressurizing liquid (e.g., pressurizing water) alone, or a mixed fluid of a pressurizing gas (e.g., pressurizing nitrogen) and a liquid (e.g., deionized water).

The release nozzles 168 are connected to the controller 5 via a control line and controlled by the controller 5. In addition, a position detector 169 is provided inside the annular member 167 to detect a position of the wafer W adsorbed to the membrane 204. In the modification of the present exemplary embodiment, the position detector 169 detects, for example, the height of the back surface of the wafer W adsorbed to the membrane 204. The position detector 169 has, for example, a capturing unit that captures the inside of the top ring guide 151 and detects the height of the back surface of the wafer W from the captured image.

The controller 5 controls the pressure of a gas supplied into the membrane 204 by using the position of the wafer W (e.g., the height of the back surface of the wafer W) detected by the position detector 169. For example, in the present exemplary embodiment, the controller 5 performs a control to supply a gas into the membrane 204 at the first pressure PS1 before the position of the wafer W reaches the position where the release nozzles 168 are capable of ejecting the pressurizing fluid to the back surface of the wafer W. Meanwhile, when the position of the wafer W reaches the position where the release nozzles 168 are capable of ejecting the pressurizing fluid to the back surface of the wafer W, the controller 5 performs a control to supply the gas into the membrane 204 at the second pressure PS2 which is lower than the first pressure PS1. Further, the controller 5 performs a control to eject the pressurizing fluid from the release nozzles 168 toward the back surface of the wafer W.

According to this configuration, by reducing the wafer release pressure at the timing when the release nozzles 168 eject the pressurizing fluid, the stress applied to the wafer W may be reduced.

Subsequently, a specific example of the process performed by the controller 5 for the above-described release of the wafer W will be described. When the height of the back surface of the wafer W detected by the position detector 169 is equal to or higher than the height H1 of the ejection ports of the release nozzles 168, the controller 5 performs a control to supply a gas into the membrane 204 at the first pressure PS1. Accordingly, the gas is supplied to the ripple area (the ripple chamber) 206 inside the membrane 204 at the first pressure PS1.

When the membrane 204 is inflated so that the height of the back surface BS (see FIG. 11) of the wafer W detected by the position detector 169 becomes lower than the height H1 (see FIG. 11) of the ejection ports of the release nozzles 168, the controller 204 performs a control to supply the gas into the membrane 204 at the second pressure PS1 which is lower than the first pressure PS1. Further, the controller 5 performs a control to eject a pressurizing fluid F2 from the release nozzles 168 toward the back surface of the wafer W.

According to this configuration, since the wafer release pressure may be reduced at the timing when the release nozzles 168 eject the pressurizing fluid, the release performance of the wafer W may be made satisfactory.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A substrate processing apparatus comprising:

a top ring including an elastic membrane configured to hold a substrate;

a pressure regulator configured to regulate a pressure of a gas supplied into the elastic membrane; and a controller configured to control the pressure regulator to make the pressure of the gas supplied into the elastic membrane variable to separate the substrate from the elastic membrane, wherein the controller is further configured to control the pressure of the gas supplied into the elastic membrane according to a type of a substrate currently held by the top ring using the information stored in a storage including a plurality of types of substrates and a first pressure and a second pressure lower than the first pressure associated with each type of substrate.

2. The substrate processing apparatus of claim 1, wherein the type of the substrate is a film type of a substrate.

3. The substrate processing apparatus of claim 1, wherein the controller is configured to change the pressure of the gas in stages.

4. The substrate processing apparatus of claim 1, further comprising:

a top ring guide configured to receive the top ring;

a nozzle formed in the top ring guide and configured to eject a pressurizing fluid toward a radially inward side of the top ring guide between the wafer and the membrane; and a position detector formed in the top ring guide and configured to detect a position of a substrate adsorbed to the elastic membrane, wherein the controller is further configured to change the pressure of the gas when the position of the substrate reaches a position where the nozzle is configured to eject the pressurizing fluid to a back surface of the substrate.

5. The substrate processing apparatus of claim 4, wherein the controller is further configured to supply the gas into the elastic membrane at the first pressure before the position of the substrate reaches a position where the nozzle is configured to eject the pressurizing fluid to the back surface of the substrate, and to supply the gas into the elastic membrane at the second pressure when the position of the substrate reaches a position where the nozzle is configured to eject the pressurizing fluid to the back surface of the substrate.

6. The substrate processing apparatus of claim 5, wherein the position detector is configured to detect a height of the back surface of the substrate adsorbed to the elastic membrane as the position of the substrate, and the controller is further configured to supply the gas into the elastic membrane at the first pressure when the height of the back surface of the substrate that is detected by the position detector is equal to or higher than a height of an ejection port of the nozzle, and to supply the gas into the elastic membrane at the second pressure lower than the first pressure when the height of the back surface of the substrate that is detected by the position detector becomes lower than the height of the ejection port of the nozzle and to eject the pressurizing fluid from the nozzle toward the back surface of the substrate.

7. The substrate processing apparatus of claim 1, wherein the controller changes the pressure of the gas according to an inflating rate of the elastic membrane.

8. The substrate processing apparatus of claim 1, wherein the pressure regulator is an electropneumatic regulator.

* * * * *